US007192508B2

(12) United States Patent
Torvund

(10) Patent No.: US 7,192,508 B2
(45) Date of Patent: Mar. 20, 2007

(54) DEVICES TO CONDUCT CURRENT TO OR FROM THE ELECTRODES IN ELECTROLYSIS CELLS, METHODS FOR PREPARATION THEREOF, AND AN ELECTROLYSIS CELL AND A METHOD FOR PRODUCTION OF ALUMINUM BY ELECTROLYSIS OF ALUMINA SOLVED IN A MELTED ELECTROLYTE

(75) Inventor: Johnny Torvund, Tolvsrød (NO)

(73) Assignee: Servico A.S., Olso (NO)

( * ) Notice: Subject to any disclaimer, the term of this patent is extended or adjusted under 35 U.S.C. 154(b) by 569 days.

(21) Appl. No.: 10/433,044

(22) PCT Filed: Nov. 23, 2001

(86) PCT No.: PCT/NO01/00464

§ 371 (c)(1),
(2), (4) Date: Oct. 15, 2003

(87) PCT Pub. No.: WO02/42525
PCT Pub. Date: May 30, 2002

(65) Prior Publication Data

US 2004/0050714 A1 Mar. 18, 2004

(30) Foreign Application Priority Data

Nov. 27, 2000 (NO) ..... 20005984

(51) Int. Cl.
*C25C 3/12* (2006.01)

(52) U.S. Cl. ..... 204/243.1; 204/247.3; 204/279; 204/280; 29/745; 29/746; 29/747

(58) Field of Classification Search ..... 204/243.1, 204/247.3, 279, 280; 205/372, 374, 380, 205/384, 385, 388; 29/745, 746, 747
See application file for complete search history.

(56) References Cited

U.S. PATENT DOCUMENTS 4,417,097 A * 11/1983 Das ..... 204/290.01
4,612,105 A * 9/1986 Langon ..... 204/288.2

(Continued)

FOREIGN PATENT DOCUMENTS

RU 2085624 7/1997

*Primary Examiner*—Bruce F. Bell
(74) *Attorney, Agent, or Firm*—Senniger Powers

(57) ABSTRACT

Device (1) to conduct current to or from the electrodes of an electrolysis cell, which device in the direction towards the electrolysis cell comprises three types of segments; at least one outer segment (2) joined with at least one intermediate segment (3) which again is joined with at least one inner segment (4); where the outer segment (2) has at least one end (5) which is to/shall extend out from an electrode body (6) towards an outer current circuit, and the outer segment is coupled to at least one intermediate segment (3) which again is coupled to at least one inner segment with at least one section (4) or end (7) in the electrode body; where the inner segment (4) is manufactured from steel, the intermediate segment is manufactured with a steel lining (8) over an inner core of a material (9) with better electrical and thermal conductivity than steel, and the outer segment is manufactured from a material (9) with better electrical and thermal conductivity than steel. The devices are distinguished in that the material (9) with better electrical and thermal conductivity than steel is chosen amongst aluminium, copper, silver, alloys and intermetals thereof, preferably pure aluminium and soft copper, the intermediate segment with core of the material (9) with better electrical and thermal conductivity than steel, extends into the electrode body, and the joining between the inner segment and the intermediate segment is by means of a friction weld or induction weld via a steel insert.

17 Claims, 9 Drawing Sheets

U.S. PATENT DOCUMENTS 4,647,356 A * 3/1987 Leroy ..... 204/247.4
5,154,813 A * 10/1992 Dill ..... 204/288.2
5,380,416 A * 1/1995 McMinn ..... 204/245
5,538,607 A * 7/1996 Pate ..... 204/280
5,597,461 A * 1/1997 Pate ..... 228/170
6,113,756 A * 9/2000 Juric et al. ..... 204/243.1
6,419,813 B1 * 7/2002 Brown et al. ..... 205/374
6,977,031 B1 * 12/2005 Jakovac et al. ..... 204/280

* cited by examiner 52
51
50
49
48
55
56
57
58
59
54
53

DEVICES TO CONDUCT CURRENT TO OR FROM THE ELECTRODES IN ELECTROLYSIS CELLS, METHODS FOR PREPARATION THEREOF, AND AN ELECTROLYSIS CELL AND A METHOD FOR PRODUCTION OF ALUMINUM BY ELECTROLYSIS OF ALUMINA SOLVED IN A MELTED ELECTROLYTE

FILED OF THE INVENTION

The present invention regards devices to conduct current to or from the electrodes of electrolysis cells, methods for preparation thereof, and an electrolysis cell and a method for production of aluminium by electrolysis of alumina solved in a melted electrolyte.

BACKGROUND OF THE INVENTION AND PRIOR ART

Electrolysis is the chemical process which takes place at the electrodes when direct current is passed through an electrolyte in contact with the electrodes. More specific, compounds which are dissociated into ions in the electrolyte is reduced at the cathode and oxidized at the anode, by means of an applied current. One of the most important electrolysis processes is electrolysis of alumina solved in a melted halogenide electrolysis bath, for example an electrolysis bath of cryolite. The process which is utilized when producing aluminium the Hall-Heroult-process which was invented simultaneously and independently by the American Hall and the Frenchman Heroult, is about one hundred years old and has not been developed flier as far as other processes of electrolysis. This is probably due to the harsh conditions which are required to perform electrolysis and to keep the electrolysis bath in an operative condition, for example a temperature in the electrolyte up to 980° C.

By electrolysis, and in particular by electrolysis of alumina for production of aluminium, a significant loss is present in the form of a reduced current efficiency and loss of heat, and for production of aluminium the energy cost is a very significant part of the total cost. Technology which could provide better current efficiency would lead to significant savings. This problem is general when it comes to electrolysis, and the invention is in general applicable for the electrolysis industry, in addition to that it could be applicable within other industrial fields where corresponding problems are found, for example in other energy consuming industry and within the energy network However, the present invention is in particular focused on aluminium production.

The terms voltage drop, conductivity, resistance and current efficiency are used interchangeably in the following as it is found natural and are used in general by skilled persons. It is assumed that skilled persons know the relationship between the terms, for example by the Ohm's law and Faraday's law for electrolysis, and know how the terms are interrelated with the problem of the present invention.

In cells for electrolysis of alumina for production of aluminium it is today utilized in general two main types of anodes, namely the so called prebaked anodes and anodes of the Söderberg type. It also exists non-carbon anodes and non-carbon cathodes which are relevant for utilization with the present invention, but these have so far no or little utilization and will therefore not be considered specifically. The anodes are usually formed of carbon with an inner current bus bar, namely anode hangers and anode bolt (anode stud bolt), whereto current is applied. The current is passed from said current conducting devices through the carbon of the anode and into the electrolyte where electrolysis takes place, and further into the cathode, optionally first through a layer of melted aluminium on the cathode, and to the current conduction devices of the cathode, and from there for example in series to the next electrolysis cell.

Voltage drop appears all over the electrolysis cell, of which the most significant voltage drop takes place over the electrolyte. However, voltage drop also appears to the current conducting devices, which means the current bus bars of the anodes, namely the anode hangers and the anode bolts, and current bus bars of the cathodes, Taking into account that the amount of current through a typical electrolysis oven of today for production of aluminium is between 100000 and 300000 ampère, even a small reduction of the voltage drop will be very significant.

In the devices for conducing current at present materials as iron or steel are used, optionally with outer parts of copper or aluminium, and the design is so that the voltage drop is to be minimized. For a simple description, it is by the term steel in the following considered both iron- and steel alloys.

The current bus bars of the cathode are at present manufactured form massive steel in the part which is to be incorporated into the cathode, optionally with ends extending from the electrolysis cell, which ends are of another material with better conductivity, for example copper. The part of the anode hangers or anode bolts which is to be incorporated into the carbon is at present manufactured from steel, while the upper, upwardly extending part via a bimetal transition is manufactured from aluminium. The devices of today contain several welds, usually manual welds performed in difficult welding positions, with resulting poor quality with low conductivity and strength for example, the bimetal transition results in three welds, namely a manual above and a manual below, in addition to the bimetal welding which is roll-welded at high temperature and high pressure.

In practical utilization at present in anodes and cathodes of carbon, in the a within and close to the electrode body (electrode mass), it is utilized current bus bars of massive steel. Efforts have been taken to replace this material with better conducting materials closer towards the electrolysis bath, which in practice has been very difficult. In patent publication NO 162083 description is found on an anode hanger for holding a carbon containing anode in cells for production of aluminium. According to said publication the anode hanger for holding a carbon containing anode in cells for production of aluminium by electrolysis of the melt according to the Hall-Heroult-process, consists of an upper part of a metal such as aluminium, copper or steel, which is joined by an anode beam or something corresponding, and a lower current conducting steel part which is fastened to the upper part and which comprises a yoke with downward extending nipples whereto the carbon containing anode is secured, and said anode hanger is in particular distinguished in that the upper part is fastened to the lower current conducting steel part by means of a cast-joining of aluminium or copper. In practice the yoke according to NO 162083 is produced by filling a void in the yoke by melted aluminium which then solidifies and makes the inner part of the yoke, which thereby is supposed to be a better conductor, However, the anode hanger according to the above publication has by experience appeared not to be industrially applicable, by several reasons. More specific it has been observed that the joining between the cast aluminium and the steel has not sufficient mechanical strength under the harsh conditions to withstand the thermal expansion. The components are disintegrated, in particular the joining steel/aluminium, the carbon around the nipples is breaking up and the carbon can fall down into the electrolyte ("cowboy"). An uneven current conduction appears both by the known devices and the anode hanger according to NO 162083, indicated by non-uniform carbon deterioration. Despite significant efforts to provide improvements with respect to reduced voltage drop, so far it has not been possible to provide devices which are industrially applicable. Poor thermal conductivity is also a problem with the prior art devices. Accordingly, a significant demand for improvements exists.

OBJECTIVE AND TECHNICAL EFFECT OF THE INVENTION

The objective of the present invention is to provide improvements with respect to reduced voltage drop, better electrical and thermal conductivity and better current distribution, by to a larger extent utilizing materials having better electrical and thermal conductivity than steel which at the present is utilized, and by reducing the number and improve the quality of the welds. The achievements of the present invention include better conductivity of heat and current, with resulting consequences of the operation, of which in particular the possible maximum therethrough the cell is important, and further improvements can be provided with respect to manufacturing, assembling, replacements, prefabrication, incorporation and recovery of the devices.

SUMMARY OF THE INVENTION

The objective of the invention is met most surprisingly by choice of specific features with respect to constructive design, materials and the methods for manufacturing, according to what appears from the enclosed patent claims.

With the present invention it is provided a device for conducting current to or from the electrodes of an electrolysis cell, in that the device has design and is distinguished as apparent from claim 1.

Essential features of the invention is in particular that there are no arc welds or fusion welds in the longitudinal direction of the device between unequal materials, but instead friction weld or induction weld, and that no utilization is made of cast alloys, in particulars cast aluminium, but preferably pure aluminium or soft copper are used as material having better electrical and thermal conductivity than steel.

In the detailed description different aspects of the invention are discussed further.

Preferred embodiments of the invention, and methods in particular applicable for the manufacture thereof, and a cell for electrolytic production of aluminium by electrolysis of alumina solved in a melted electrolyte, and a method for production of aluminium, appear from the enclosed patent claims and are described in more detail below, with reference to the enclosed drawings.

DRAWINGS

DETAILED DESCRIPTION

Figure 1:
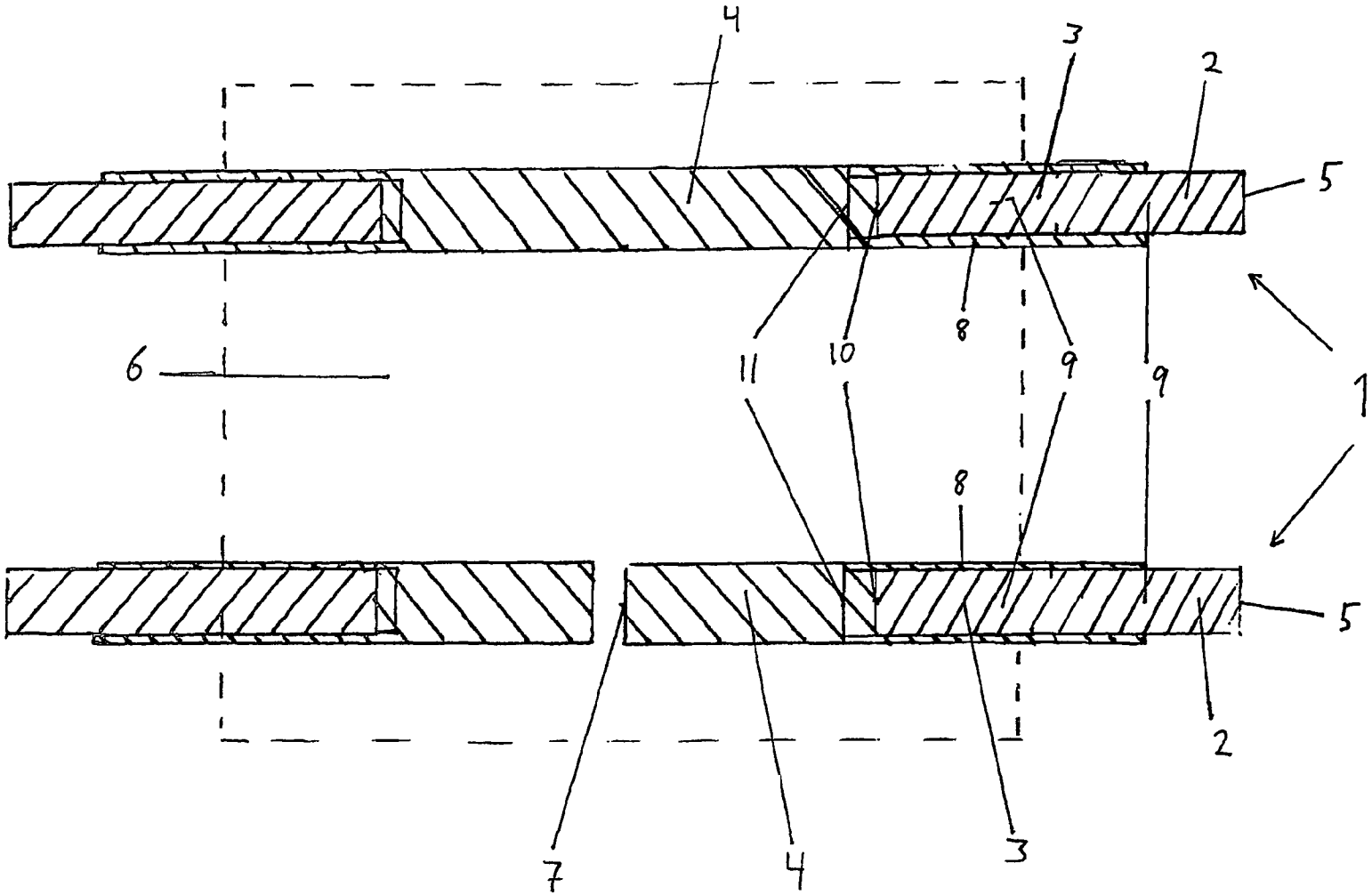
FIG. 1 is a section which in principle illustrates the device according to the invention.

Reference is made to FIG. 1, where it is illustrated a device 1 to conduct current to or from the electrodes of an electrolysis cell, which device provides both increased conduction of heat away from the electrolysis bath of the electrolysis cell and reduced electrical voltage drop, and thereby possibility for electrolysis at increased current/current density and reduced voltage drop, which device in the direction towards the electrolysis cell comprises three types of segments; at least one outer segment 2 joined with at least one intermediate segment 3 which again is joined with at least one inner segment 4; where the outer segment 2 has at least one end 5 which should extend out from an to electrode body 6 towards an outer current circuit, and the outer segment is coupled to at least one intermediate segment 3 which again is coupled to at least one inner segment with at least one section 4 or end 7 in the electrode body; where the inner segment 4 is manufactured from steel, the intermediate segment is manufactured with a steel lining 8 over an inner core of a material 9 with better electrical and thermal conductivity than steel, and the outer segment is manufactured from a material 9 with better electrical and thermal conductivity than steel, and the device or the components thereof has optionally a coating applied, and the device has optionally expansion joints or flexible segments to handle temperate induced movements, and the device is distinguished in that the material 9 with better electrical and thermal conductivity than steel is chosen from the group consisting of aluminum, copper, silver, alloys and intermetals thereof, preferably pure aluminium and soft copper, the intermediate segment with core of the material 9 with better electrical and thermal conductivity than steel, extends into the electrode body, and the joining between the inner segment and the intermediate segment is by means of a friction weld or induction weld between the inner core of the intermediate segment and a steel insert with dimensions corresponding to said inner core, in that the steel insert in one end is friction welded or induction welded to the inner core of the intermediate section 10 and in the other end is friction welded or induction welded 11 to the massive inner steel segment, where the last mentioned weld also comprises the outer steel lining 8.

The above mentioned steel insert will for some embodiments, where it is more in agreement with the common terminology in the art be termed a small nipple.

Pure aluminium and soft copper, which melt at 658.5° C. and 1083° C., respectively, are preferably the materials to replace steel. Other materials can also be relevant, for example other aluminium alloys, alloys with lots of copper, and silver, but in particular the weldability and the costs am limiting factors. Aluminium different from pure aluminium can be useful, for example different aluminium alloys, such as AA 6063, but these will, however, in general provide lower quality welds with the obligatory welding methods, and provide reduced conductivity, and the increased strength results in that by temperature induced movements of the steel are not so easily followed. By similar reasons soft, pure copper is preferred over for example electrolytic copper, however, the choice of type of copper or copper alloy is less critical than choice of aluminium since the weldability is better. Other materials, for example silver, are most relevant as optional coatings. However, it would be preferable to delimit the utilization of different materials to avoid contact voltage drops between different materials and to keep the joining and manufacturing simple Therefore, it is in general most preferred to use pure aluminium as core in devices where the core temperature can be maintained below ca. 400° C. during operation, and copper as core material where the temperature during operation can be maintained under ca. 780° C., in both situations with an inner segment of massive steel in the direction towards the electrolysis bath. Devices with both steel, copper and pure aluminium in the core are useful, but in agreement with the above, only preferred when so are specified below, It is considered to be within the skill of the persons in the art to test different variations of the devices with steel, pure aluminium and/or copper taking into account the costs, voltage drop, temperature in the core, ease of fabrication and replacement, and other aspects mentioned or discussed herein.

The problems of pure electrical contact and probably also thermal between better conducting material and steel, appear to be solved by using friction welds or induction welds according to the invention. Thereby it is probably achieved better welds over the full cross-section, with significantly reduced content of oxides and other unwanted compounds. In the transition towards massive steel in the longitudinal direction it is required to utilize an intermediate section or an insert of massive steel, for example a smaller nipple having a diameter or a cross-section equal to or smaller than the material with better conductivity, because this surprisingly gives a significant improvement with respect to weldability and ease of fabrication. A uniform weld over the full cross-section, together with the preferred choice of materials and constructive features, appear to be essential. Optional problems by recrystallization of pure aluminium surprisingly appear to be eliminated by use of the welding methods and a process for manufacturing according to the invention.

Conveniently 99.5% by weight pure aluminium or aluminium of purer grade is utilized, preferably 99.9% by weight pure aluminium.

Electron beam welding or laser welding are possible alternative acceptable welding methods.

Figure 8:
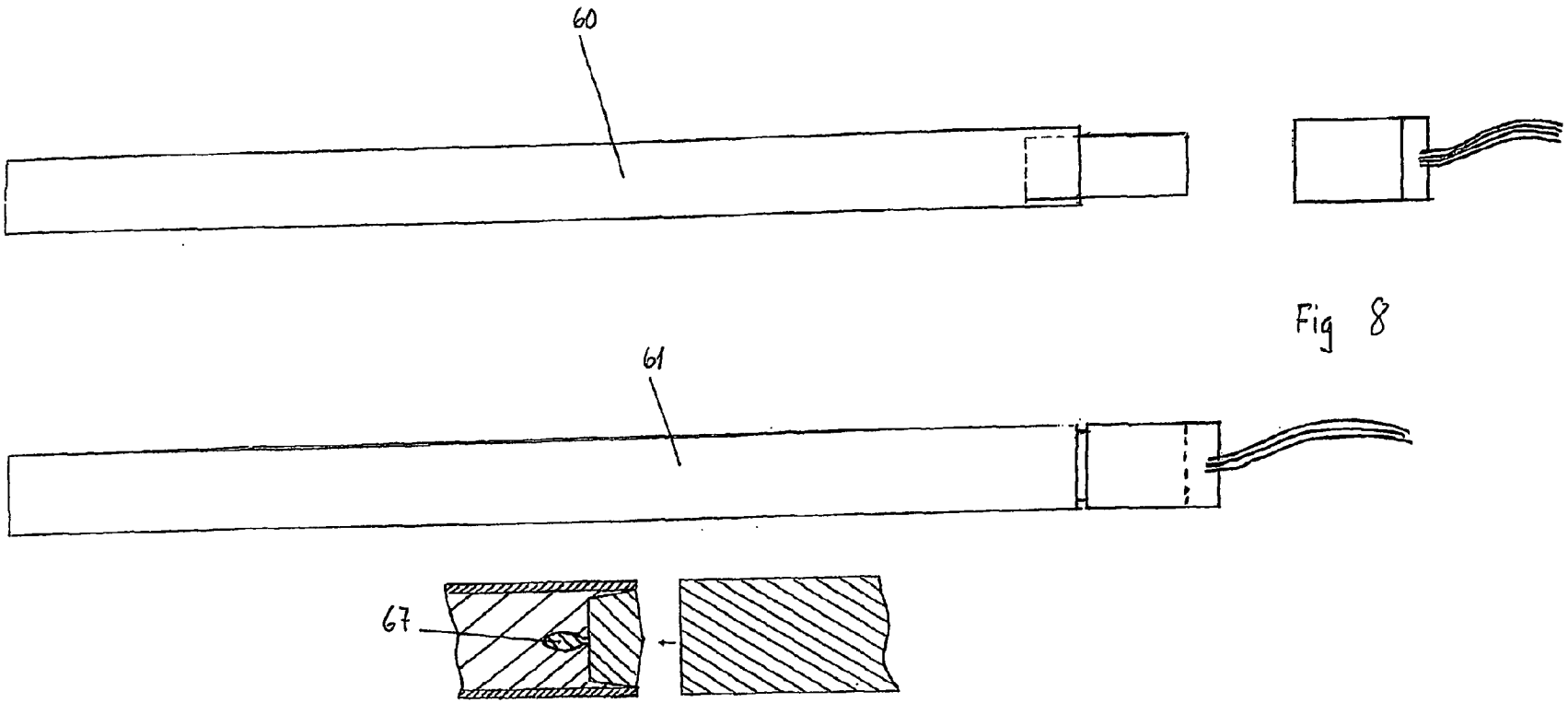
FIG. 8 illustrates further cathode bus bars according to the invention, and a steel insert according to the invention having convex recession into the core of the intermediate segment of a device according to the invention.

In a preferred embodiment the steel insert between the inner core of the intermediate segment and the inner segment is designed with a recession into the inner core of the intermediate segment, most preferred a convex recession 67, as illustrated on FIG. 8. Thereby increased welding area and improved mechanical, electrical and thermal joining is achieved.

Further it might be preferable to have a point or an elevated center area of the surfaces which are to be welded together by friction welding or induction welding, because this appears to result in reduced oxide content in the weld.

Figure 2:
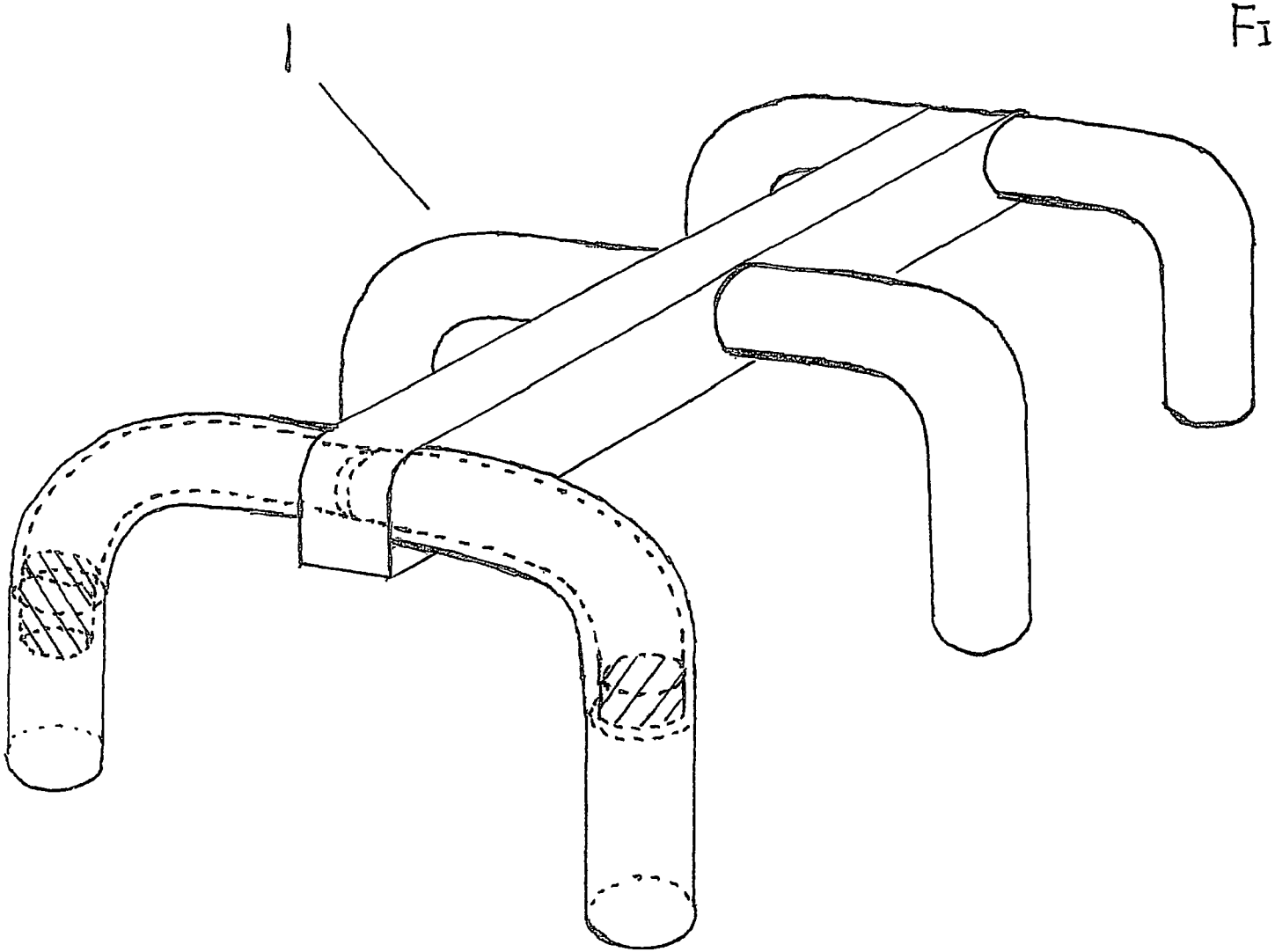
FIG. 2 is a drawing which shows an anode hanger having six nipples according to the invention, where the inner core of pure aluminum or copper is indicated in two of the nipples, with different transitions to the lower positioned massive steel nipple.

In the following some preferred embodiments of the invention are described in further detail, Reference is further made to FIG. 2 which is an outline of an anode hanger 1 with six nipples, with a typical outside design, FIG. 3 which is a section of an anode hanger with three nipples, and FIG. 4 which is a section of another anode hanger with four nipples. On FIG. 2 the transition towards massive steel nipple according to the embodiments illustrated on FIGS. 3 and 4, respectively, is indicated in one nipple for each embodiment, respectively with the right hand hatch for FIG. 3 and the left hand hatch for FIG. 4. As indicated in FIG. 2, the core of the material of better conductivity extends into most of the nipple length, as indicated for two of the nipples.

Figure 3:
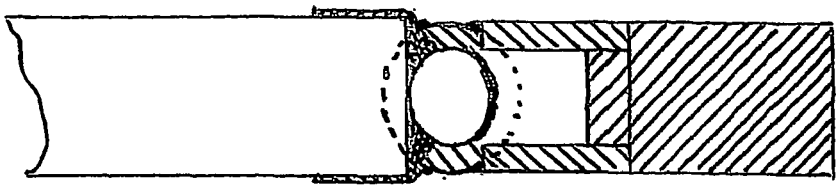
FIG. 3 is a section through an anode hanger with three nipples according to the invention.
Figure 3:
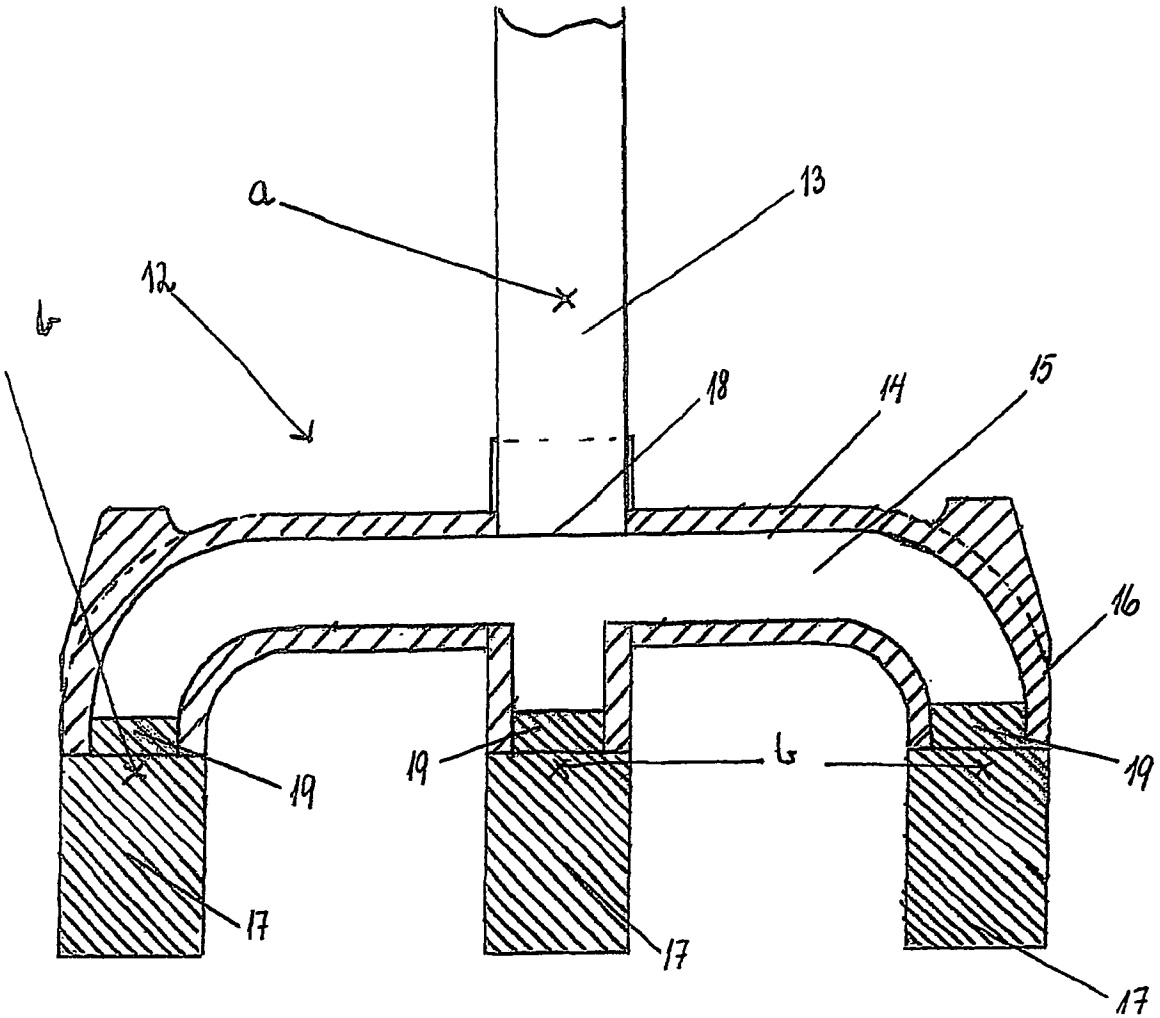

Reference is made to FIG. 3 which illustrates a device, characterized in that it is a device for conducting current to an anode of the prebaked type of carbon or non-carbon, more specific an anode hanger 12, for production of aluminium by electrolysis, where the device comprises an upper part 13 manufactured of pure aluminium or copper, a lower part 14, a so called yoke, where the upper parts of the yoke 14 have a core 15 of pure aluminium or copper with a steel lining 16, and the lower parts of the yoke comprise nipples 17 of massive steel; where the transition 18 from the upper part to the core of the yoke is without a bimetal transition, but instead is with a single weld pure aluminium-pure aluminium or copper-copper of the type friction weld, induction weld or arc weld or with a weld pure aluminium-copper of the type friction weld or induction weld or is designed in one massive piece; where the inner core 15 of pure aluminium or copper in the yoke 14 is shrink fitted into the outer steel lining 16 or the outer steel lining is fitted around the core, to the lower part of the core 15 it is friction welded or induction welded small steel nipples 19, whereto later larger massive steel nipples 17 have been friction welded or induction welded, where the nipples optionally have leaf-type design or three dimensional dendritic design or corrugated design, and where the upper part of the device is of pure aluminium or copper optionally having a large surface area and/or a large cross-section area for increased beat conduction, and/or with external cooling, and the device optionally has one or more expansion joints to take up temperature induced movements.

Figure 4:
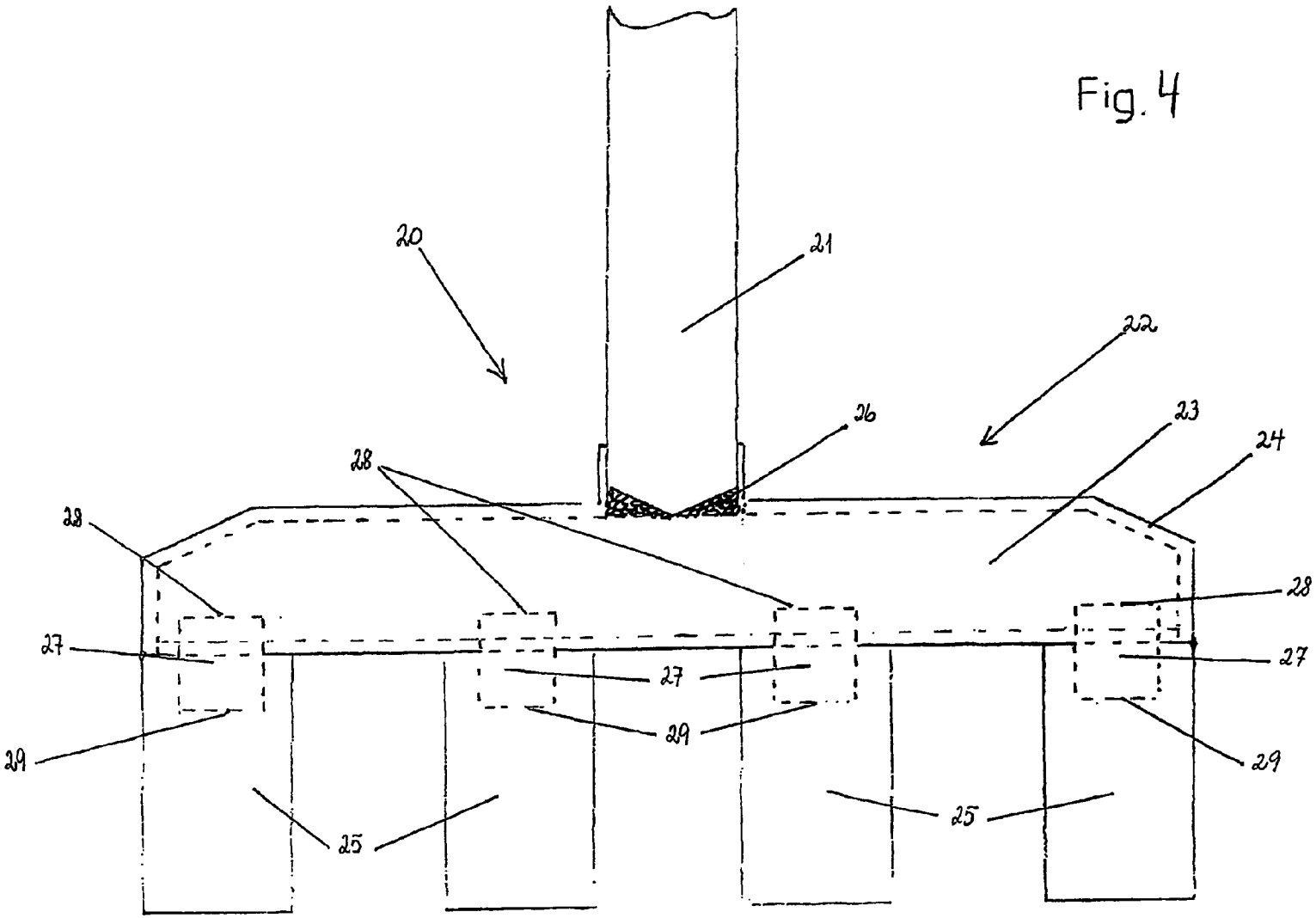
FIG. 4 is a section through a further anode hanger having four nipples according to the invention.

Further, reference is made to FIG. 4, which illustrates a little different device for conducting circuit to an anode of the prebaked type of carbon or non-carbon, more specific an anode hanger 20, for production of aluminium by electrolysis, where the device comprises an upper part 21 manufactured from pure aluminium or copper, a lower part 22, a so called yoke, where the upper parts of the yoke 22 have a core 23 of pure aluminium or copper with a steel lining 24, and the lower parts of the yoke comprise nipples 25 of massive steel; where the transition 26 from the upper part to the core of the yoke is without a bimetal transition, but instead is with a single weld pure aluminium-pure aluminium or copper-copper of the type friction weld, induction weld or arc weld, or with a weld pure aluminium-copper of the type friction weld or induction weld or is manufactured in one massive piece; where the inner core 23 of pure aluminium or copper of the yoke 22 is shrink fitted into the outer steel lining 24 or the outer steel lining is fitted around the core, to the lower part of the core 23 it is induction welded small nipples 27 of steel, whereto later it have been induction welded larger massive steel nipples 25, where the small nipples 27 is recessed into the core of the yoke of pure aluminium or copper in one end 28 and into the larger massive steel nipples in the other end 29.

Figure 5:
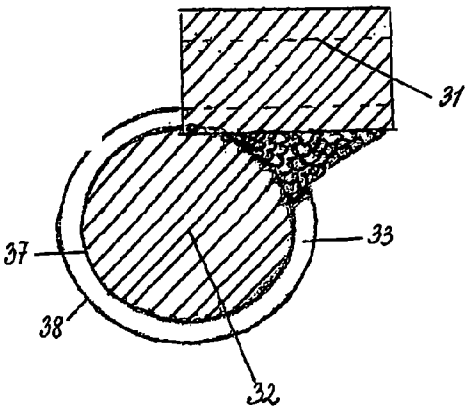
FIG. 5 illustrates an anode bolt according to the invention.
Figure 5:
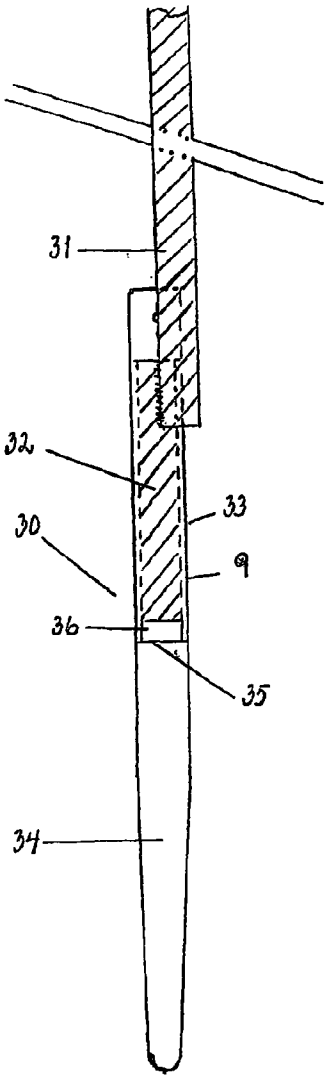
Figure 5:
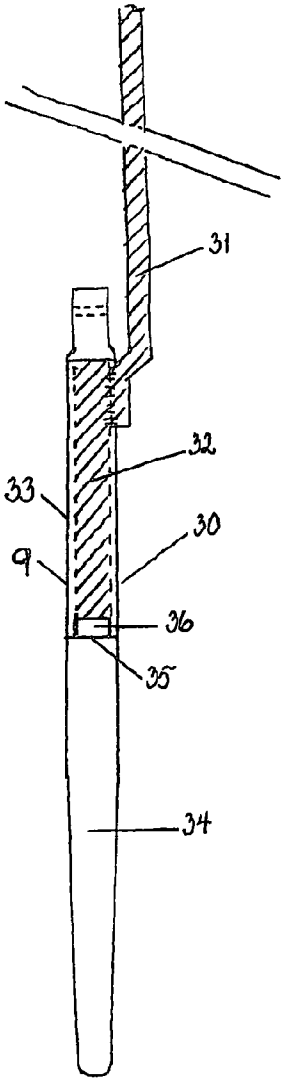

Another preferred embodiment of the device according to the invention, with reference to FIG. 5, is an anode bolt.

More specific it is on FIG. 5 illustrated an anode bolt 30 (stud bolt) for conducting current to an anode of the Söderberg type for aluminium production by electrolysis of alumina solved into a melted fluoride electrolyte, where the anode bolt comprises an upper part 31 of pure aluminium and/or copper with a lower part 32 with a core of pure aluminium and/or copper which is shrink fitted or enclosed into a steel lining 33, and a lower part 34 of massive steel, where the welded joint 35 towards the massive steel 34 is in the form of a friction weld or an induction weld, via a smaller nipple 36 of steel, and where the surface 38 towards the core optionally has been metallized and the surface 39 extending toward the electrode body optionally has a coating applied, for example a coating including tungsten.

The optional outer coating provides better protection against upwardly rising gases, for example oxygen, carbon dioxide and halogen containing gases, and up to a double life-time has been observed for anode bolts having such coating.

Figure 6:
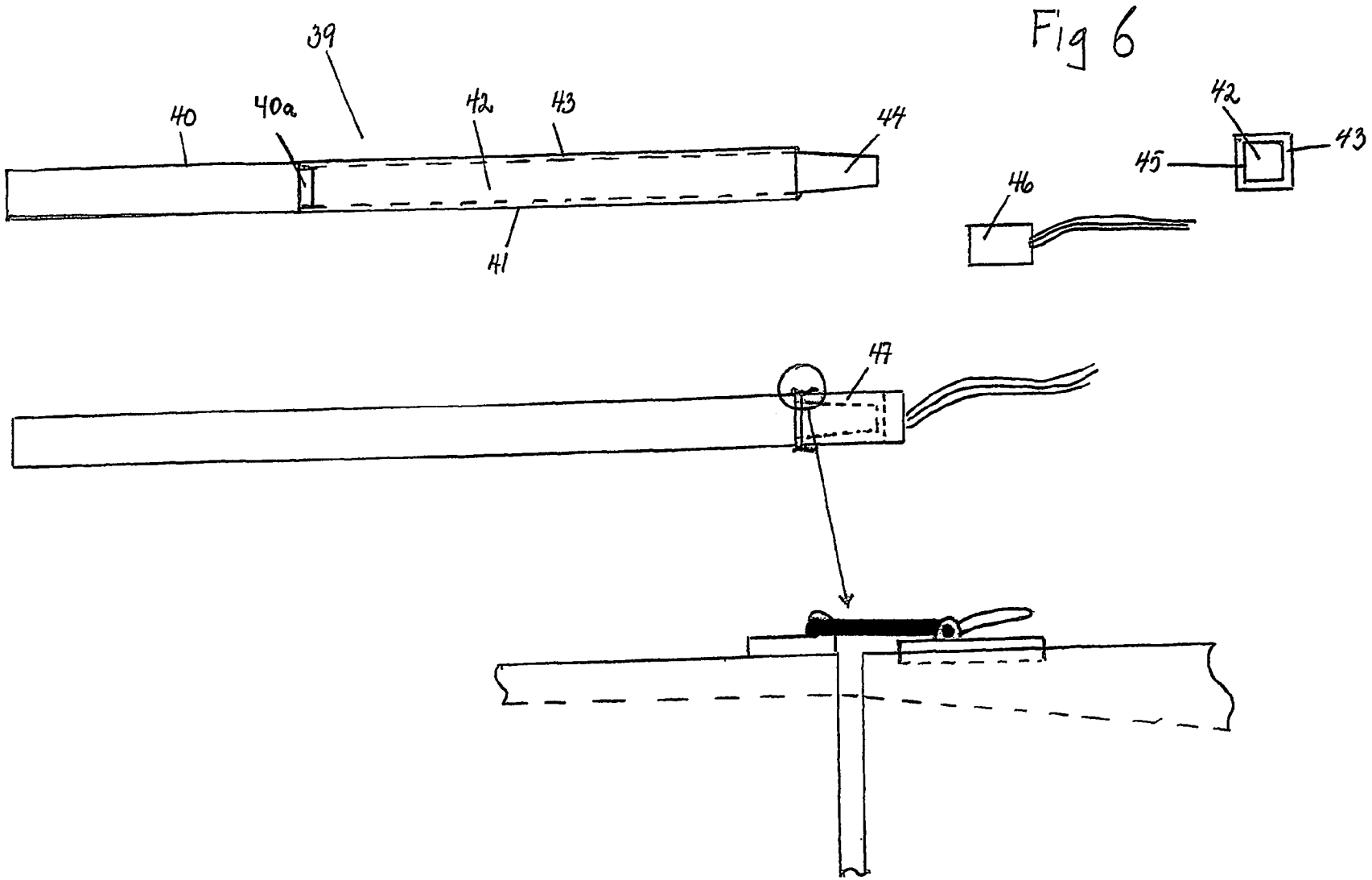
FIG. 6 illustrates cathode bus bars according to the invention.

A third preferred embodiment of the device according to the invention is a cathode current bus bar (often termed cathode steel). Reference is made to FIG. 6 which illustrates a cathode bus bar 39 for conducting current from the cathode in a cell for production of aluminium by electrolysis of alumina solved in a melted electrolyte, where the device 39 comprises an inner segment 40 of steel, where the inner segment in one or both ends via a steel insert 40*a* is coupled to an intermediate segment 41 with a copper core 42 covered with an outside steel lining 43, and an outer segment 44 of copper extending further out from the intermediate segment, in that the outer steel lining 43 on the intermediate segment comprises flat steel or iron/steel of other form which is welded thereon and which can enclose the inner copper core 42, where the flat steel 43 is metallized with copper on the surfaces 45 facing the copper core, where the outer segment 44 of the copper extends further out than the outer steel lining, sufficient to that by introduction into an electrolysis cell the outer segment 44 can extend out from the wall of the electrolysis cell while the steel lining just extends out from the wall of the electrolysis cell, where the extending copper ends 44 are designed to be friction welded or induction welded to a part 46 of copper or pure aluminium which goes directly into an external current circuit or are designed for being coupled thereto via a cup 47 or a fish joint of copper or pure aluminium, a threaded joint or a shell-joint.

Figure 7:
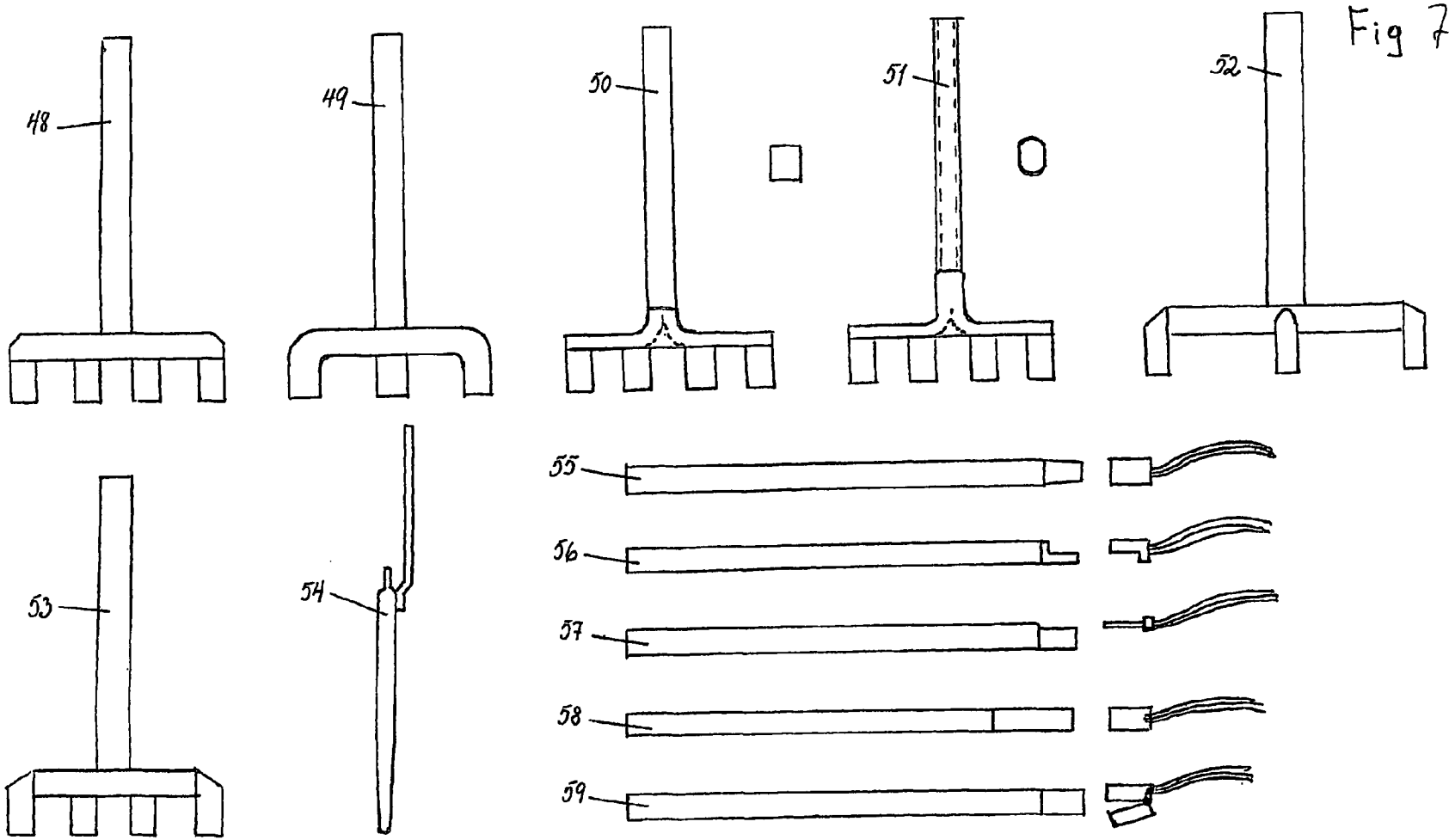
FIG. 7 illustrates some further embodiments of the device according to the invention.

The invention also comprises further embodiments within the spirit of the invention and scope of the present patent application. Some of the Her embodiments are illustrated on FIG. 7, where the reference numerals 48 to 53 illustrate anode hangers, the reference numeral 54 illustrates a further anode bolt, and the reference numerals 55 to 59 illustrate cathode bus bars. For the cathode bus bars it is illustrated, with reference numerals 55 to 59, coupling towards the outer current circuit by quick connection, fish joint, a threaded joint, induction weld or a shell-joint, respectively.

Figure 9:
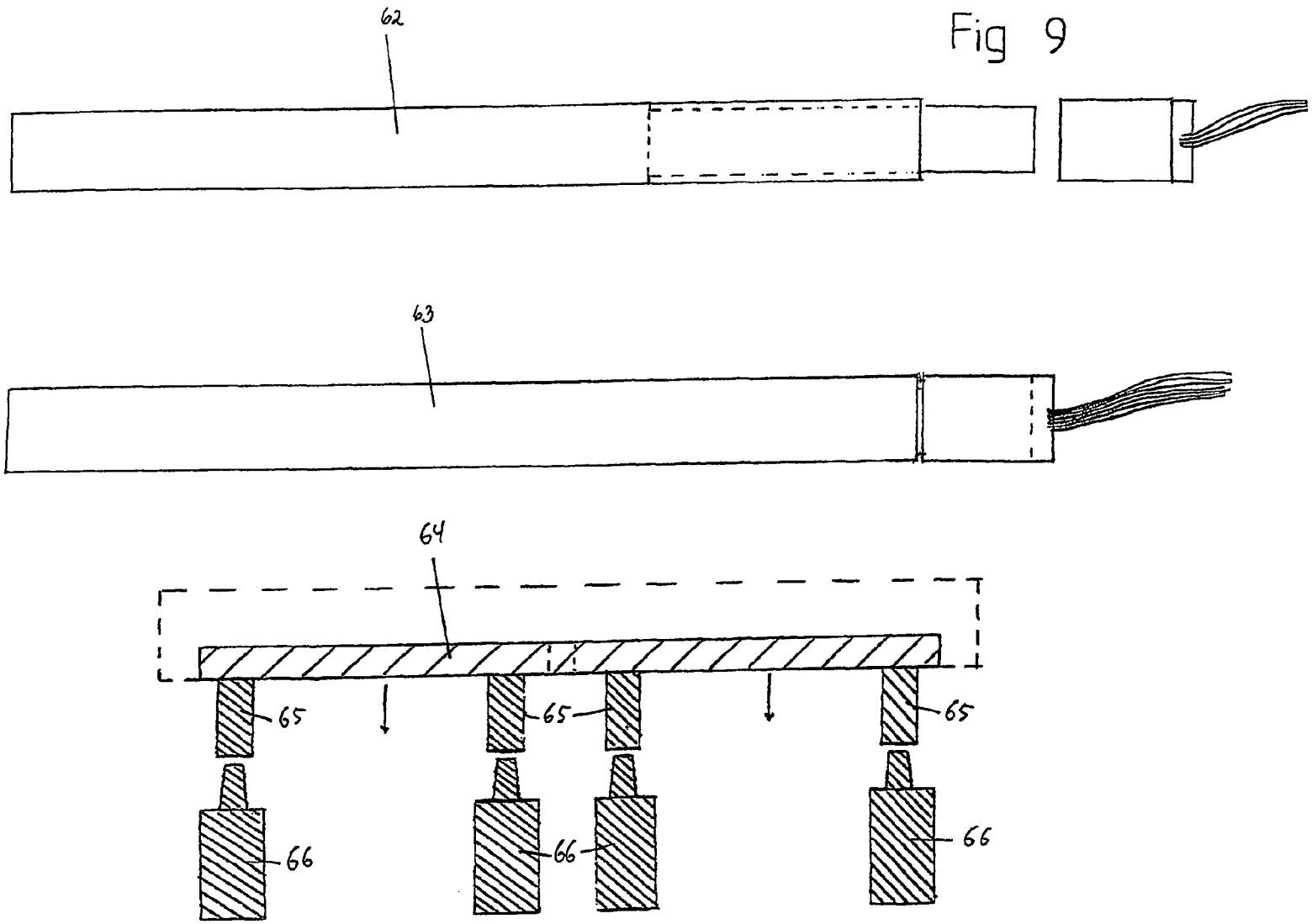
FIG. 9 illustrates further cathode bus bars according to the invention.

Reference is also made to the FIGS. 8 and 9, which illustrate some flier cathode bus bars 60, 61, 62, 63, with induction welded copper bolt or rod of respectively shorter or longer length, and coupling to the outer current circuit, and a particularly preferred cathode bus bar 64 according to the invention is illustrated on FIG. 9, with 4 intermediate segments and outer segments orientated vertically downwards.

The cathode bus bar 64 comprises more than two intermediate segments 65 connected to more than two outer segments 66, in that the intermediate segments and the outer segments extend vertically down from the electrode body or horizontally out from the electrode body. Thereby a particular low voltage drop and heat conduction is achieved.

The invention does also comprise methods particularly suitable for manufacturing the devices according to the invention, more specific the most preferred embodiments thereof.

Accordingly the invention comprises a method for manufacturing an anode hanger according to the invention, according to claim 3, whereby small steel nipples are friction welded or induction welded to massive pure aluminium bolt or copper bolt of equal diameter, the outer steel ling is optionally provided with a coating on the outside and the inside; the outer steel lining is shrink fitted or encased onto the inner core of pure aluminium or copper of the yoke; the lower massive steel nipples are friction welded or induction welded to the smaller steel nipples and the lower parts of the core of the yoke with outer steel lining; the upper part is welded to the pure aluminium or copper in the yoke, whereby the upper part of pure aluminium or copper either is going directly over into one or more of the nipples of the yoke, whereto the remaining nipples with a core of pure aluminium or copper are welded, or are welded directly to the core of the yoke, without an arc weld or fusion weld when joining different materials, but with friction weld or induction weld; the yoke is formed to its intended form, preferably by induction bending nipples in the area having a core of pure aluminium or copper to intended position, at choice before, in between or after welding.

The invention also comprises a method for manufacturing another anode hanger according to the invention, according to claim 6, whereby small nipples of steel or copper are induction welded to massive pure aluminium bolt or copper bolt of larger diameter or cross-section, wherein a recession adapted to the smaller nipples has been preformed; the small nipples of steel or copper are induction welded to the massive steel nipples of larger diameter or cross-section, whereby it has been preformed recessions adapted to the smaller nipple in the larger massive steel bolt; the outer steel lining is provided with optional coatings on the outside and inside; the outer steel lining is shrink fitted or encased onto the inner core of the pure aluminium or copper of the yoke; the upper part is welded to the pure aluminium or copper of the yoke, whereby the upper part of pure aluminium or copper either goes directly over into one or more of the nipples of the yoke, whereto the remaining nipples having a core of pure aluminium or copper are welded, or are welded directly to the core of the yoke, without arc weld or fusion weld when joining different materials, but with friction weld or induction weld; the yoke is formed to its intended form, preferably by induction bending nipples in areas with core of pure aluminium or copper to intended position, at choice before, in between or after welding.

Further, the invention comprises a method for manufacturing au anode bolt according to the invention, according to claim 7, whereby small steel nipples are friction welded or induction welded to the lower position part of pure aluminium or copper, whereby the steel nipples have diameter equal to or smaller than the pure aluminum or copper; whereby the lower part of pure aluminium or copper is shrink fitted into or is encased with an outer steel lining; whereby a lower part of massive steel is welded by friction or induction, via the steel nipple, to the inner core of pure aluminium or copper, whereby the lower part of pure aluminum or copper goes directly over to the upper part of pure aluminium or copper or is welded thereto, in the case of welding between equal materials, by induction, friction or arc welding, in the case of weld between different materials, by induction or friction; whereby optional coatings have been pre-applied to the steel surface around the circumference towards the inner core and on the surface towards the electrode body.

The invention also comprises a method for manufacturing a cathode bus bar according to the invention, according to claim 8, whereby the inner massive steel segment is prepared by arc welding onto it a steel sheeting, for example in a height of 50 mm, whereby the steel segment is positioned vertically and the steel sheeting is adapted with an opening for the inner copper core of the intermediate segment, where after the copper core with a steel insert prewelded by friction or induction is positioned into the sheeting and is induction welded to the inner massive steel core, in one or both ends, where after the copper core is lined with four metallized flat irons or flat steels, where after the four flat steels are pressed and held into position against the inner copper core under high pressure and high temperature, while the four flat steels are arc welded together, and the outer ends are prepared before or after according to the intended type of connection to the external current circuit.

Further, the invention comprises a cell for electrolytic production of aluminium by electrolysis of alumina solved in a melted electrolyte, distinguished in that the cell comprises anode hangers according to the invention and/or anode bolt according to the invention and cathode bus bars according to the invention, In a cell there are typically for example 8 anode hangers along each longitudinal side, which make a total of 16, or for cells of the Söderberg-type, 48 anode bolts. At present there are for example 6 to 48 cathode bus bars per cell. The numbers can be outside the above disclosures, The invention also comprises a method for production of aluminium, distinguished in that the electrolysis cell according to the invention is utilized, whereby the production is undertaken at a relatively high current density or a high current, and a low voltage drop and a low anode-cathode distance.

Dimensions, cross-sections and number of the devices according to the invention, and the methods for preparation, are typical according to the prior art, or can be chosen based on typical considerations by skilled persons, with the proviso that the distinctive features of the invention are maintained,

EXAMPLE

An anode hanger according to the invention was prepared by the preferred method of the invention described for the device according to claim 3. Friction welding was used for joining towards the massive steel nipples and a smaller steel nipple, and from the smaller steel nipple to the core of 99.5% by weight pure aluminium. Measurements of electrical parameters were between the points a and b on FIG. 3, and the temperature was measured under b in FIG. 3. The massive bolt of pure aluminium in the core of the nipples had a diameter of 100 mm, the friction welded smaller steel nipple had a diameter of 100 mm and a length of 50 mm, the outer steel lining was a pipe with an outer diameter of 140 mm and an inner diameter of 100 mm. The lower massive steel nipple had a diameter of 140 mm, The upper part with dimensions of 170×120 mm of pure aluminium was arc welded to the yoke and the upper part of the yoke was encased with a steel lining by manual arc welding. Remark that the specified dimensions are only typical dimensions for an anode hanger, and that dimensions may vary considerably. The fiction welding was performed with equipment and procedures from Black's Equipments, Doncaster, England. The results of the measurements are given in the Tables 1 and 2.

As it appears from Table 1 the resistance over the feed measurement distance was reduced from typically 5–6 micro ohm to typically 1.3 micro ohm. In a cell it is typically 16 anode hangers and the total current of the cell is typically ca. 150 kA. The voltage drop over the anode hanger is reduced by ca. 30 mV, and calculated according to Faraday's law of electrolysis this amounts to more than 1.5 ton additional aluminium per year per cell. For a typical plant having for example 600 ovens this amounts to 900 tons extra aluminium. The current efficiency will increase by ca. 1.5%.

TABLE 1

Electrical parameters, measured values

| According to the invention | Voltage, mV | Current KA | Resistance micro ohm |
|---|---|---|---|
| Yes | 9-9-9 | 6.0 | 1.5 |
| Yes | 12-10-10 | 7.4 | 1.5 |
| Yes | 10-8-10 | 9.3 | 1.0 |
| Yes | 9-8-10 | 6.8 | 1.3 |
| Yes | 13-11-13 | 7.3 | 1.7 |
| Yes | 13-12-13 | 7.4 | 1.7 |
| No, standard anode hanger | 40-36-46 | 8.3 | 4.5 |
| No, standard anode hanger | 47-38-57 | 7.9 | 6.0 |
| No, standard anode hanger | 44-39-46 | 7.6 | 5.7 |

TABLE 2

Temperature measurements in ° C.

| Anode hanger | Outer nipple | Intermediate nipple | Inner nipple |
|---|---|---|---|
| According to the invention | 268 | 221 | 238 |
| According to the invention | 297 | 287 | 318 |
| Standard, not according to the invention | 371 | 410 | 362 |

It is assumed that the improvements are due to better possibilities as a result of the invention for performing electrolysis at high current, low voltage drop and low anode-cathode distance, without creation of process disturbances.

As it appears from Table 2 it is a significant reduction of temperature in the nipples with the anode hanger according to the invention, in that the reduction of temperature was in the range from 44 to 189° C. The temperature in the nipple was reduced from in average 381° C. to in average 272° C. The implications are significant with respect to current and heat losses, for example it is possible to increase the current strength without occurrence of process disturbances. The temperature reduction is due to that pure aluminium is a far better heat conductor than steel. A somewhat similar effect will be achieved with copper. It is considered that conditions with respect to further reduced flow velocities in the melt results in further decrease in heat transfer number bath/coating (crust) and metal/coating, which increase the demand for better heat conduction through the current conducting devices.

Skilled persons may based on the patent claims and the description with enclosed figures be able to set forth many different embodiments which are not specifically described but are inside the spirit and scope of the invention as these appear from the patent claims. For example it may be used to exclude the inner segment of massive steel, whereby the device may have an outer segment, with a steel lining on the inner part, of pure aluminium or copper, induction- or friction welded to the intermediate segment of preferably copper, with a steel lining. Further, it would be preferable with a copper coating towards the anode beam on the anode hangers and the anode bolts with the upper segment of pure aluminium, where the copper coating (metallization) is formed to a plough form pointing upwards to lead away oxide and other matter from the contacting area towards the anode beam, in addition to that repair of the scratches on the contact surface can be made easier and at lower costs. Further, the steel lining on the intermediate segment on the devices according to the invention can be rolled to the inner core at high temperature and high pressure, in particular for embodiments with a circular cross-section. Circular cross-sections may be preferable with respect to the cost for the raw materials. Compared to the prior art the devices according to the invention are preferable even though the intermediate segment is not extending into the electrode body, but is joined towards the inner segment at the outside of the electrode body. Accordingly, also embodiments which only in par make use of the distinguishing features of the invention, can be preferable compared to prior art.

The invention claimed is:

1. Device (1) to conduct current to or from the electrodes of an electrolysis cell, which device provides both increased conduction of heat away from the electrolysis bath of the electrolysis cell and reduced electrical voltage drop, and thereby possibility for electrolysis at increased current/current density and reduced voltage drop, which device in the direction towards the electrolysis cell comprises three types of segments; at least one outer segment (2) joined with at least one intermediate segment (3) which again is joined with at least one inner segment (4); where the outer segment (2) has at least one end (5) which is to extend out from an electrode body (6) towards an outer current circuit, and the outer segment is coupled to at least one intermediate segment (3) which again is coupled to at least one inner segment with at least one section (4) or end (7) in the electrode body; where the inner segment (4) is manufactured from steel, the intermediate segment is manufactured with a steel lining (8) over an inner core of a material (9) with better electrical and thermal conductivity than steel, and the outer segment is manufactured from a material (9) with better electrical and thermal conductivity than steel, and the device or the components thereof has optionally a coating applied, and the device has optionally expansion joints or flexible segments to handle temperature induced movements, characterized in that the material (9) with better electrical and thermal conductivity than steel is chosen from the group consisting of aluminium, copper, silver, alloys and intermetals thereof, preferably pure aluminium and soft copper, the intermediate segment with core of the material (9) with better electrical and thermal conductivity than steel, extends into the electrode body, and the joining between the inner segment and the intermediate segment is by means of a friction weld or induction weld between the inner core of the intermediate segment and a steel insert with dimensions corresponding to said inner core, in that the steel insert in one end is friction welded or induction welded to the inner core of the intermediate section (10) and in the other end is friction welded or induction welded (11) to the massive inner steel segment, where the last mentioned weld also comprises the outer steel lining (8).

2. Device according to claim 1, characterized in that the steel insert between the inner core of the intermediate segment and the inner segment is designed with a recession into the inner core of the intermediate segment, preferably a convex recession (67).

3. Device according to claim 1, characterized in that it is a device for conducting current to an anode of the prebaked type of carbon or non-carbon, more specific an anode hanger (12), for production of aluminium by electrolysis, where the device comprises an upper part (13) manufactured of pure aluminium or copper, a lower part (14), a so called yoke, where the upper parts of the yoke (14) have a core (15) of pure aluminium or copper with a steel lining (16), and the lower parts of the yoke comprise nipples (17) of massive steel; where the transition (18) from the upper part to the core of the yoke is without a bimetal transition, but instead is with a single weld pure aluminium-pure aluminium or copper-copper of the type friction weld, induction weld or arc weld or with a weld pure aluminium-copper of the type friction weld or induction weld or is designed in one massive piece; where the inner core (15) of pure aluminium or copper in the yoke (14) is shrink fitted into the outer steel lining (16) or the outer steel lining is fitted around the core, to the lower part of the core (15) it is friction welded or induction welded small steel nipples (19), whereto later larger massive steel nipples (17) have been friction welded or induction welded, where the nipples optionally have leaftype design or three dimensional dendritic design or corrugated design, and where the upper part of the device is of pure aluminium or copper optionally having a large surface area and/or a large cross-section area for increased heat conduction, and/or with external cooling, and the device optionally has one or more expansion joints to take up temperature induced movements.

4. Device according to claim 3, characterized in that the electrical resistance from the surface (a) in the middle of the upper part to the surface in the middle of the nipple (b) under the yoke is less than or equal to 1.7 micro ohm, and that the temperature in the centre under (b) in the nipple is 268–297° C. for the outer nipple, 221–287° C. for the intermediate nipple and 238–318° C. for the inner nipple, when taking measurements during operation before the carbon of the anode is replaced.

5. Method for manufacturing the device according to claim 3, characterized in that small steel nipples are friction welded or induction welded to massive pure aluminium bolt or copper bolt of equal diameter; the outer steel lining is optionally provided with a coating on the outside and the inside; the outer steel lining is shrink fitted or encased onto the inner core of pure aluminium or copper of the yoke; the lower massive steel nipples are friction welded or induction welded to the smaller steel nipples and the lower parts of the core of the yoke with outer steel lining; the upper part is welded to the pure aluminium or copper in the yoke, whereby the upper part of pure aluminium or copper either is going directly over into one or more of the nipples of the yoke, whereto the remaining nipples with a core of pure aluminium or copper are welded, or are welded directly to the core of the yoke, without an arc weld or fusion weld when joining different materials, but with friction weld or induction weld; the yoke is formed to its intended form, preferably by induction bending nipples in the area having a core of pure aluminium or copper to intended position, at choice before, in between or after welding.

6. Cell for electrolytical production of aluminium by electrolysis of alumina solved in a melted electrolyte, characterized in that the cell comprises devices according to claim 3.

7. Device according to claim 1, characterized in that the pure aluminium is 99.5% by weight pure aluminium or aluminium of a purer grade, preferably 99.9% by weight pure aluminium.

8. Device according to claim 1, characterized in that it is a device for conducting current to an anode of the prebaked type of carbon or non-carbon, more specific an anode hanger (20), for production of aluminium by electrolysis, where the device comprises an upper part (21) manufactured from pure aluminium or copper, a lower part (22), a so called yoke, where the upper parts of the yoke (22) have a core (23) of pure aluminium or copper with a steel lining (24), and the lower parts of the yoke comprise nipples (25) of massive steel; where the transition (26) from the upper part to the core of the yoke is without a bimetal transition, but instead is with a single weld pure aluminium-pure aluminium or copper-copper of the type friction weld, induction weld or arc weld, or with a weld pure aluminium-copper of the type friction weld or induction weld or is manufactured in one massive piece; where the inner core (23) of pure aluminium or copper of the yoke (22) is shrink fitted into the outer steel lining (24) or the outer steel lining is fitted around the core, to the lower part of the core (23) it is induction welded small nipples (27) of steel, whereto later it have been induction welded larger massive steel nipples (25), where the small nipples (27) is recessed into the core of the yoke of pure aluminium or copper in one end (28) and into the larger massive steel nipples in the other end (29).

9. Method for manufacturing of the device according to claim 8, characterized in that small nipples of steel or copper are induction welded to massive pure aluminium bolt or copper bolt of larger diameter or cross-section, wherein a recession adapted to the smaller nipples has been preformed; the small nipples of steel or copper are induction welded to the massive steel nipples of larger diameter or cross-section, whereby it has been preformed recessions adapted to the smaller nipple in the larger massive steel bolt; the outer steel lining is provided with optional coatings on the outside and inside; the outer steel lining is shrink fitted or encased onto the inner core of the pure aluminium or copper of the yoke; the upper part is welded to the pure aluminium or copper of the yoke, whereby the upper part of pure aluminium or copper either goes directly over into one or more of the nipples of the yoke, whereto the remaining nipples having a core of pure aluminium or copper are welded, or are welded directly to the core of the yoke, without arc weld or fusion weld when joining different materials, but with friction weld or induction weld; the yoke is formed to its intended form, preferably by induction bending nipples in areas with core of pure aluminium or copper to intended position, at choice before, in between or after welding.

10. Cell for electrolytical production of aluminium by electrolysis of alumina solved in a melted electrolyte, characterized in that the cell comprises devices according to claim 8.

11. Device according to claim 1, characterized in that the device is a cathode bus bar (39) for conducting current from the cathode in a cell for production of aluminium by electrolysis of alumina solved in a melted electrolyte, where the device (39) comprises an inner segment (40) of steel, where the inner segment in one or both ends via a steel insert (40*a*) is coupled to an intermediate segment (41) with a copper core (42) covered with an outside steel lining (43), and an outer segment (44) of copper extending further out from the intermediate segment, in that the outer steel lining (43) on the intermediate segment comprises flat steel or iron/steel of other form which is welded thereon and which can enclose the inner copper core (42), where the flat steel (43) is metallized with copper on the surfaces (45) facing the copper core, where the outer segment (44) of the copper extends further out than the outer steel lining, sufficient to that by introduction into an electrolysis cell the outer segment (44) can extend out from the wall of the electrolysis cell while the steel lining just extends out from the wall of the electrolysis cell, where the extending copper ends (44) are designed to be friction welded or induction welded to a part (46) of copper or pure aluminium which goes directly into an external current circuit or are designed for being coupled thereto via a cup (47) or a fish joint of copper or pure aluminium, a threaded joint or a shell-joint.

12. Method for manufacturing the device according to claim 11, characterized in that the inner massive steel segment is prepared by arc welding onto it a steel sheeting, for example in a height of 50 mm, whereby the steel segment is positioned vertically and the steel sheeting is adapted with an opening for the inner copper core of the intermediate segment, where after the copper core with a steel insert prewelded by friction or induction is positioned into the sheeting and is induction welded to the inner massive steel core, in one or both ends, where after the copper core is lined with four metallized flat irons or flat steels, where after the four flat steels are pressed and held into position against the inner copper core under high pressure and high temperature, while the four flat steels are arc welded together, and the outer ends are prepared before or after according to the intended type of connection to the external current circuit.

13. Cell for electrolytical production of aluminium by electrolysis of alumina solved in a melted electrolyte, characterized in that the cell comprises devices according to claim 11.

14. Device according to claim 1, characterized in that the device is a cathode bus bar (64) comprising more than two intermediate segments (65) connected to more than two outer segments (66), in that the intermediate segments and the outer segments extend vertically down from the electrode body or horizontally out from the electrode body.

15. Cell for electrolytical production of aluminium by electrolysis of alumina solved in a melted electrolyte, characterized in that the cell comprises devices according to claim 14.

16. Method for manufacturing the device according to claim 1 wherein the device is an anode bolt comprising an upper part of at least one of pure aluminum and pure copper and a lower part with a core of at least one of pure aluminum and pure copper which is shrink fitted or enclosed in into a steel lining, the method, characterized in that small steel nipples are friction welded or induction welded to the lower position part of pure aluminium or copper, whereby the steel nipples have diameter equal to or smaller than the pure aluminium or copper; whereby the lower part of pure aluminium or copper is shrink fitted into or is encased with an outer steel lining; whereby a lower part of massive steel is welded by friction or induction, via the steel nipple, to the inner core of pure aluminium or copper; whereby the lower part of pure aluminium or copper goes directly over to the upper part of pure aluminium or copper or is welded thereto, in the case of welding between equal materials, by induction, friction or arc welding, in the case of weld between different materials, by induction or friction; whereby optional coatings have been pre-applied to the steel surface around the circumference toward the inner core and on the surface towards the electrode body.

17. Cell for electrolytical production of aluminium by electrolysis of alumina solved in a melted electrolyte, characterized in that the cell comprises devices according to claim 1.

* * * * *